US007494267B2

(12) United States Patent
Ware

(10) Patent No.: US 7,494,267 B2
(45) Date of Patent: Feb. 24, 2009

(54) REACTION BLOCK FOR SUPPORTING FLASKS OF DIFFERENT SIZES FOR CHEMICAL SYNTHESIS ON A HOT PLATE STIRRER

(75) Inventor: Steve Ware, Tabernacle, NJ (US)

(73) Assignee: Chemglass, Inc., Vineland, NJ (US)

( * ) Notice: Subject to any disclaimer, the term of this patent is extended or adjusted under 35 U.S.C. 154(b) by 501 days.

(21) Appl. No.: 11/214,003

(22) Filed: Aug. 30, 2005

(65) Prior Publication Data

US 2007/0047387 A1 Mar. 1, 2007

(51) Int. Cl.
*B01F 13/08* (2006.01)
*B01F 15/00* (2006.01)
*B01L 9/00* (2006.01)

(52) U.S. Cl. ..... 366/274; 366/331; 422/104

(58) Field of Classification Search ..... 126/432; 366/273, 274; 422/104, 99; 219/647, 649
See application file for complete search history.

(56) References Cited

U.S. PATENT DOCUMENTS

| | | | | | |
|---|---|---|---|---|---|
| 2,842,654 | A | * | 7/1958 | Anderson | 219/433 |
| 3,294,039 | A | * | 12/1966 | Ogden | 219/439 |
| 3,356,316 | A | | 12/1967 | Forehand | 244/43 |
| 3,356,346 | A | | 12/1967 | Landsberger | 259/71 |
| 3,594,129 | A | | 7/1971 | Jones | 23/253 |
| 3,679,869 | A | * | 7/1972 | Keeler et al. | 219/432 |
| D233,244 | S | | 10/1974 | Quandt | D32/2 |
| 4,090,263 | A | | 5/1978 | Hoffa | 366/273 |
| 4,162,855 | A | | 7/1979 | Bender | 366/274 |
| 4,170,931 | A | * | 10/1979 | Fajans | 219/460.1 |
| 4,523,083 | A | * | 6/1985 | Hamilton | 219/433 |
| 4,568,195 | A | | 2/1986 | Herz et al. | 366/274 |
| 4,629,866 | A | * | 12/1986 | Proctor | 219/439 |
| 4,752,138 | A | | 6/1988 | Rufer | 366/274 |
| 4,759,635 | A | | 7/1988 | MacMichael et al. | 366/274 |
| 4,911,555 | A | | 3/1990 | Saffer et al. | 366/274 |
| 4,991,973 | A | | 2/1991 | Maaz et al. | 366/141 |
| 5,499,872 | A | | 3/1996 | Baxter | 366/213 |
| 5,529,391 | A | | 6/1996 | Kindman et al. | 366/145 |
| 5,547,280 | A | * | 8/1996 | Wanninger et al. | 366/274 |
| D426,312 | S | | 6/2000 | Gomes | D24/220 |

(Continued)

FOREIGN PATENT DOCUMENTS

| | | | |
|---|---|---|---|
| GB | 757616 | * | 9/1956 |

(Continued)

OTHER PUBLICATIONS

Heidolph, "Parallel Synthesis", Heidolph Instruments GmbH & Co. KG, www/heidolph.com, pp. 1, 2, 5-14., publication date prior to Oct. 2006.

(Continued)

*Primary Examiner*—Tony G Soohoo
(74) *Attorney, Agent, or Firm*—Fitzpatrick, Cella, Harper & Scinto

(57) ABSTRACT

A reaction block for mounting various round bottom flasks upon a laboratory, magnetic hot plate stirrer. An aluminum inner flask holder effectively conducts heat and does not interfere with a magnetic flux. A solid heat insulating material substantially surrounds and is spaced from the flask holder, in order to keep the reaction block at a safe temperature and provide easy gripping surface regions that extend completely around its circumference.

17 Claims, 6 Drawing Sheets

U.S. PATENT DOCUMENTS

| | | | | |
|---|---|---|---|---|
| 6,100,504 | A * | 8/2000 | Wagner | 219/432 |
| 6,593,550 | B1 * | 7/2003 | Royer | 219/433 |
| 6,905,656 | B1 | 6/2005 | Ladlow et al. | 422/99 |
| D558,888 | S * | 1/2008 | Ware | D24/216 |
| 2006/0198767 | A1 | 9/2006 | Fordham | 422/104 |
| 2008/0013400 | A1 * | 1/2008 | Andrews et al. | 366/274 |
| 2008/0056957 | A1 * | 3/2008 | Hayman | 422/104 |

FOREIGN PATENT DOCUMENTS

GB 2439527 * 9/2003

OTHER PUBLICATIONS

Website screen printout, publication date approx. 2002, (printed Feb. 2, 2005), 5 pgs. http://www.glass-solutions.co.uk/acatalog/Online_Catalogue_HEAT_ON_Blocks_4.html.

Radleys, "Custom designed glass reaction systems", www.radleys.co.uk, publication date approx. 2005, pp. 1-2.

U.S. Appl. No. 29/237,279, filed Aug. 30, 2005, Steve Ware.

CG-1991 Reaction Block for Circular Top Hot Plate Stirrer, www.chemglass.com/products_new/np-reactionblcok.html; 1 pg., 2005.

DRYSYN Clean Synthesis From ASYNT & Pharmacore; www.asynt.com/archive/drysyn-usa.html; 1 pg., 2005.

ASYNT News; www.asynt.com/archive/news.html; 4 pgs. 2005.

Jepson Bolton's International Catalogue; Stirrers; ww.jepbol.com/sect4/stirika.html; 5 pgs. 2005.

IKA—Works Product; Divtech Equipment Co.; www.divtechequipment.com/rect_basic.html; 1 pg., 2005.

* cited by examiner

REACTION BLOCK FOR SUPPORTING FLASKS OF DIFFERENT SIZES FOR CHEMICAL SYNTHESIS ON A HOT PLATE STIRRER

BACKGROUND OF THE INVENTION

1. Field of the Invention

The present invention relates to a reaction block assembly capable of accommodating round bottom flasks, of different sizes, and is for use upon a magnetic stirrer integrated with a hot plate. Such stirrers generate a magnetic field, and various sizes of round bottom flasks are easily accommodated by this device for effective rotating the magnetic stir bars in the flask. The base of the assembly is aluminum and is configured to provide excellent heat transfer land and not to interfere with the magnetic field, being generated from below the hot plate surface.

2. Brief Description of the Prior Art

In the field of organic chemistry it is often desirable to perform a chemical reaction under precise heat transfer and stirring conditions. conditions. Known laboratory stirrers suited for use with the present invention include the Opti CHEM Model CG-1993-01 hot plate stirrer from Chemglass of Vineland NJ; the Ikamag RET, RCT and RH Basic magnetic stirrers from IKA of Germany; and the Heidolph MR3000 series of magnetic stirrers. Typically such hotplates are round and have a diameter of 135 mm, although some hotplate stirrers, such as the Snijders Model 34532, from Snijders of the Netherlands, employ a top plate diameter of 194 mm.

Magnetic stirrers that do not allow for heating are also known. Wanninger at al. (U.S. Pat. No. 5,547,280) illustrates a stirrer with a round, flat glass top. Other magnetic stirrers without a hotplate employ a 6 inch by 6 inch square top plate, such as the Model 1266 from Labline, or a square 7 inch by 7 inch square top plate, such as the Model S46720, from Thermolyne.

The use of reaction blocks to hold reaction vessels upon a surface of a magnetic stirrer is known. Landsburger (U.S. Pat. No. 3,356,316) illustrates a vinyl block with a plurality of test tube holders.

Where both stirring and heating are desired, prior art heat conduction blocks have been constructed of various configurations and materials. Kindmann (U.S. Pat. No. 5,529,391) illustrates thermoelectric elements and metal cooling fins attached to each of four sides of a square, aluminum heat conducting block, that then is positioned over a plurality of individual magnetic stirring devices. Ladlow et al. (U.S. Pat. No. 6,905,656) illustrates a solid adapter block with a plurality sockets to arrange test tubes outside of the periphery of a round hot plate stirrer, wherein the adapter block is said to be made of any chemically resistant material, such as PTFE, aluminum or stainless steel. Asynt, of the United Kingdom, sells a DrySyn aluminum adapter block for supporting a standard 1000 ml flask upon a round hot plate stirrer, with separate inserts available for accommodating 500 ml, 250 ml, 100 ml and 50 ml flasks, wherein two plastic handles are attached to opposing sides of a large aluminum block to allow lifting.

Such apparatus can overheat a hot plate, due to a large mass of aluminum, are difficult to manipulate and include large exposed surfaces that invite burns from inadvertent contact. The present device is advantageous over such known devices in that it allows a conventional magnetic stirrer to be used with various sizes of common round bottom flasks and features a flask holder with thin walls and a small aluminum mass, except about the center where the excellent heat transfer is concentrated. A heat shield is cooled by natural convection through interconnected narrow air spaces, and is easy and safe to manipulate, even when quickly taking the reaction block off the hot plate.

SUMMARY OF THE INVENTION

A reaction block according to the invention provides a safe and cost effective solution for replacing existing oil baths and heating mantles. An innovative heat shield, preferably of solid Teflon (PTFE resin), substantially surrounds the exterior surfaces of an inner aluminum flask holder, to both provide a substantially continuous gripping surface region and keep the entire exterior surface area at a temperature safe to touch. For example, in the preferred embodiment discussed below, the PTFE shield remained at approximately 79° C. when heating a 100 mL round bottom flask to 179° C. Thereby, various common size flasks, holding a hot liquid and one or more magnetic stir bars, can be accommodated securely in this novel reaction block and the reaction block may be quickly and securely grabbed at any vertical side surface and placed upon, or removed from, a hot plate stirrer.

The present invention provides an improved reaction block, wherein an inner flask holder is shielded both around the circumference of its vertical sides with an insulating material and also shielded at its outer upper surface by an annular surface of insulating material located between the sides and a central flask holding recess. The shielding preferably is a single piece of solid plastic or resin that is removably secured to the inner flask holder and spaced therefrom by spacers to provide a natural convection air space therebetween.

The present invention preferably provides the bottom of the inner flask holder with a lip that acts to loosely engage the side surface of a hot plate. This ensures that the reaction block is in good heat transfer contact with the hotplate and also correctly locates the supported flask centrally within the magnetic flux being generated by the magnetic stirring mechanism.

The inner flask holder preferably is cast, forged or machined from aluminum, but alternatively might be made of any non-ferrous metal, stainless steel, ceramic or other high heat transfer coefficient material that will not interfere with a magnetic flux. The preferred embodiment is an inner flask holder that has a lower surface and lip that are circular in shape, to accommodate the common, round hot plate stirrers, as discussed above, but rectangular, square or any other particular shape is contemplated.

The preferred embodiment of the improved reaction block illustrated in the drawings comprises an inner flask holder with a central recess that will engage a 100 mL round bottom flask and will accept optional inserts for 10, 25 and 50 mL flasks. A second embodiment, not illustrated, comprises a reaction block with an inner flask holder with a central recess that will engage a 500 mL flask and will accept an optional insert for engaging a 250 mL round bottom flask. Preferably the flask inserts are color coded for easy identification by the lab technician. Each of the inserts preferably are shallow cups, made of aluminum and with a common lower convex surface configuration that will make a large area contact against the concave surface of the central recess in the inner flask holder. The upper concave surfaces of the insets are likewise shaped to make a large area contact with the bottom of a particular size of inserted flask.

Hence, it is a first object of the present invention to provide a reaction block with an insulating heat shield that substantially surrounds an inner flask holder, to keep the exterior surface area at a temperature that is safe to touch.

It is a second object of the present invention to provide a reaction block with a plastic or resin covering that substantially surrounds an inner flask holder, and provides gripping surface regions completely around its circumference.

It is a third object of the present invention to provide a reaction block with an insulating heat shield, that substantially surrounds an inner flask holder which further comprises a concave, central recess that accepts a series of inserts sized to accommodate different round bottom flasks but with convex lower surfaces that will make good heat transfer contact with the central recess.

It is a fourth object of the present invention to provide a reaction block essentially comprising a round, heat conducting inner flask holder with an air space between outer surfaces thereof and a surrounding layer of insulating material so as to cool, by natural convection, a continuous vertical gripping surface region around the circumference of the device.

It is a fifth object of the present invention to provide a round reaction block essentially comprising a flask holder at its center and a surrounding layer of solid PTFE resin, wherein the inner flask further comprises a large vertically extending aluminum mass surrounding the central flask holder above a horizontal, thin wall aluminum circular element with a lower surface and vertical edge that will engage upon and around a common round hot plate stirrer.

It is a sixth object of the present invention to provide a reaction block essentially comprising a round, aluminum inner flask holder with a surrounding layer of insulating material and a central recess that will make good heat transfer contact with a series of aluminum adapters for different size flasks, that also are color coded.

BRIEF DESCRIPTION OF THE DRAWINGS

A preferred embodiment of the invention is described in detail below, with reference to the accompanying drawings, wherein.

DESCRIPTION OF THE PREFERRED EMBODIMENTS

Figure 1:
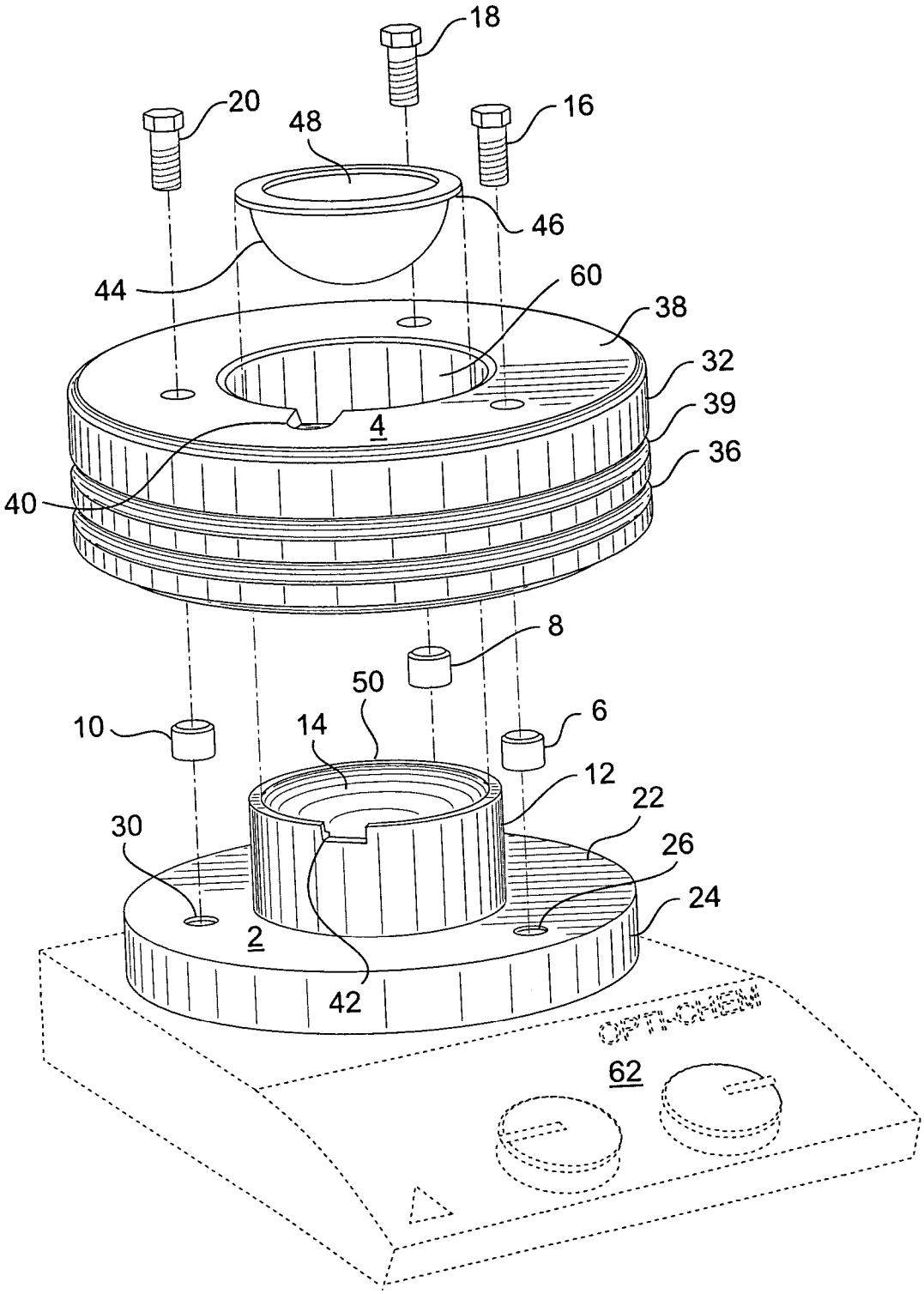
FIG. 1 is a right front perspective, explosion view of a reaction block with an optional 50 ml. flask adapter insert according to a preferred embodiment of my invention, in an intended use upon a laboratory magnetic stirrer hot plate, that is shown in dotted line.

The preferred embodiment of the improved reaction block illustrated in FIG. 1 comprises an inner flask holder 2 of machined aluminum with an encircling heat shield 4. The aluminum flask holder central element 12 has an upper support edge 50, which surrounds a concave central recess 14, and is supported above a thin wall, circular horizontal element 22. The concave central recess 14 is sized to engage the bottom of a 100 mL round bottom flask.

FIG. 1 illustrates a preferred reaction block with an insulating heat shield that is an annular solid block which substantially surrounds a central mass of an aluminum inner flask holder 2, in a manner that keeps the exterior surface 32 at a temperature that is safe to touch. A block is preferably of cast or machined rigid Teflon (PTFE) resin 4 and shaped to shield substantially all exterior surfaces of the inner flask holder 2.

Figure 2:
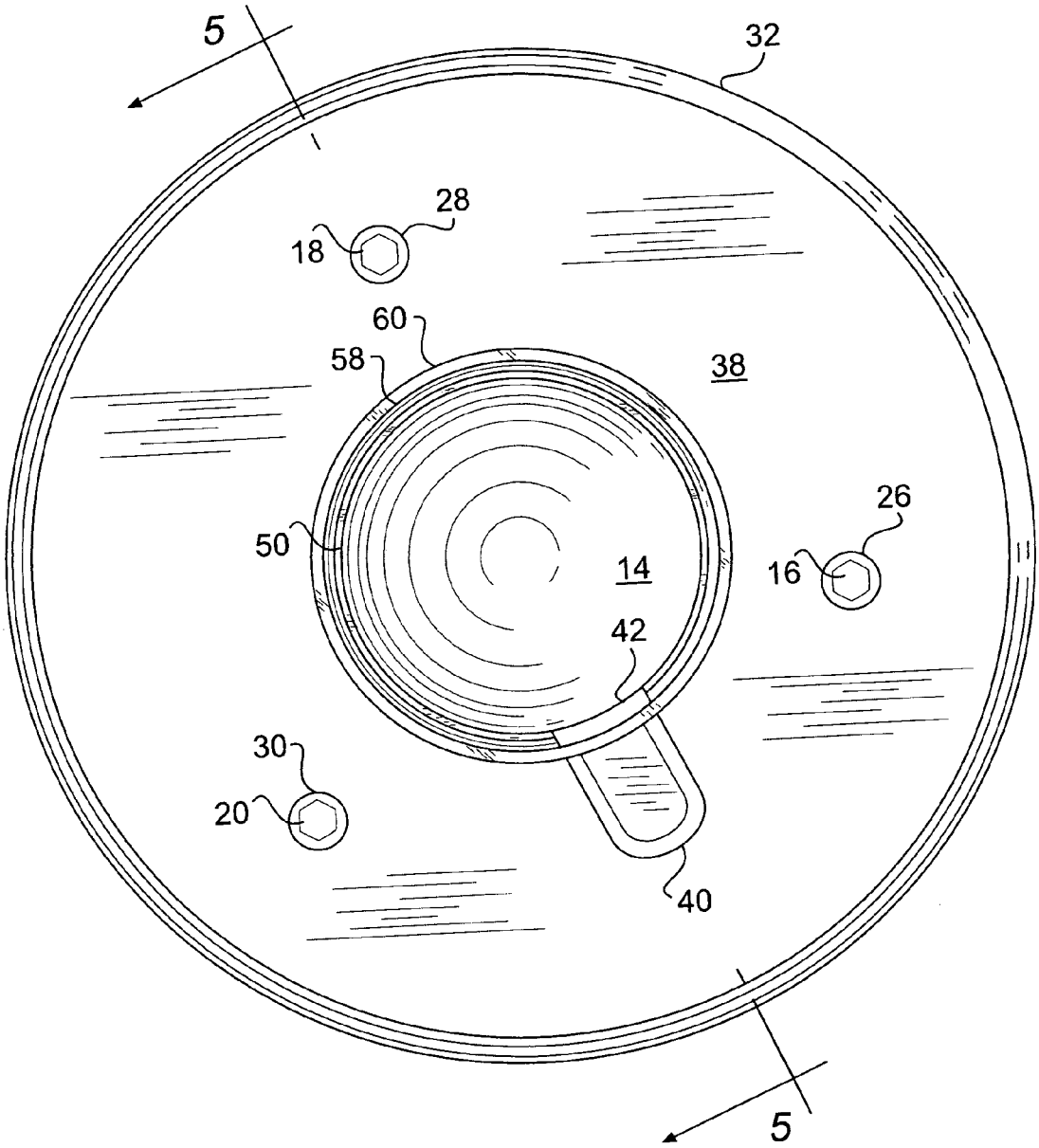
FIG. 2 is a top plan view of the reaction block of FIG. 1.
Figure 3:
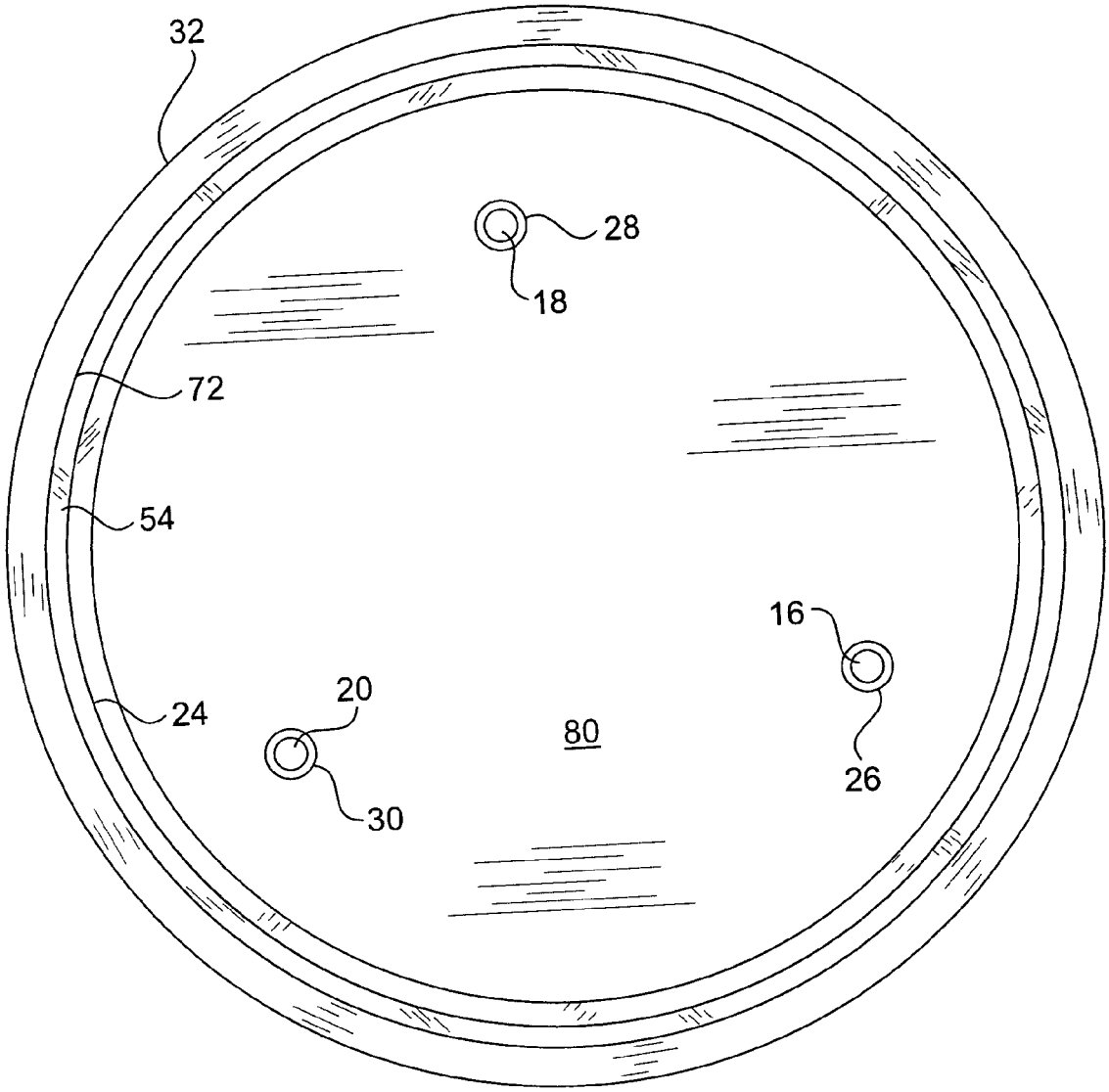
FIG. 3 is a is a bottom plan view of the reaction block of FIG. 1.
Figure 5:
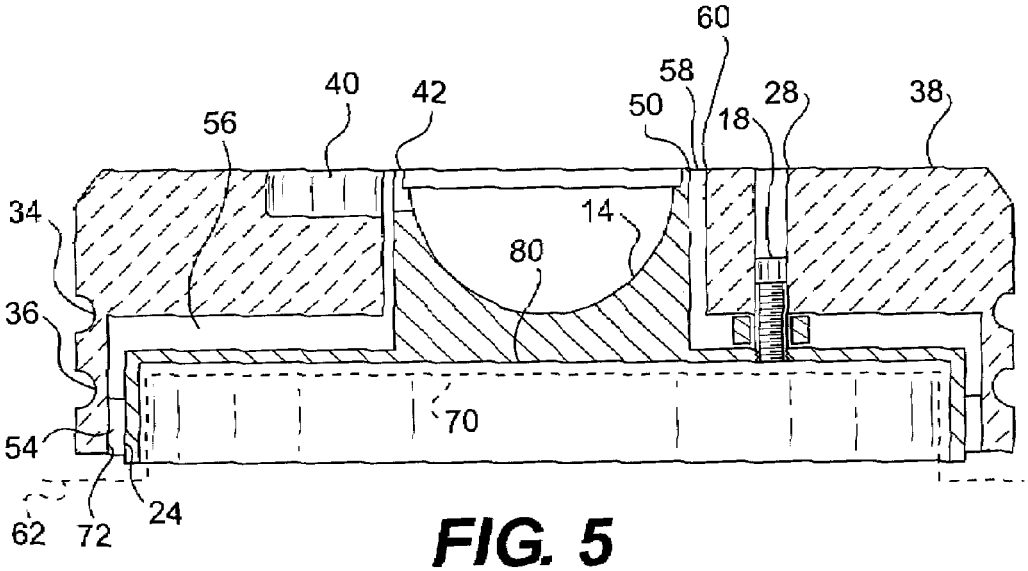
FIG. 5 is a vertical cross-section view of the reaction block of FIG. 1, taken along the line 5-5 of FIG. 2; and also in an intended use upon a top surface of a laboratory magnetic stirrer and hotplate, that is shown in dotted line.

FIGS. 2 and 3 show top and bottom plan views of the reaction block when assembled. FIGS. 1 and 5 illustrate how the shield is removably mounted and separated from hot surfaces of the flask holder by three ceramic standoffs 6,8,10 that are ½ inch in diameter and ⅜ inches in length and are spaced equally upon the horizontal element 22 around the holder central element 12. The shield is held in place by cap screws 16, 18, 20 that engage threaded holes 26, 28, 30 tapped into the top of the thin wall of horizontal element 22 and end at its lower surface 80. As shown in FIG. 5, the cap screw 18 also is countersunk in hole 28 well below the surface 38 in order to avoid a burn from contact with the head of the cap screw.

Hence, interconnected horizontal and vertical spaces create a natural convection air path. As shown in FIGS. 2 and 5, a top vertical air space 58 is defined between PTFE shield upper vertical wall 60 and flask holder top support surface 50. Likewise, a horizontal air space 56 is defined between thin wall flask holder element 22 and the lower horizontal surface of the PTFE block 4 and a bottom vertical air space 54 is defined between outside of vertical element 24 and PTFE block lower vertical wall 72. The PTFE block outer surface was found to remain at approximately 79° C. when heating a 100 mL round bottom flask to 179° C. The thin wall horizontal element 22 quickly conducts heat radially inward towards the mass of the central flask holder element 12, so the aluminum flask holder overall has a minimized amount of mass and thermal capacity. Hence, the improved reaction block quickly responds to changes in temperature being required by the controller (not illustrated) which dictates the temperature at the hot plate surface 70.

Figure 4:
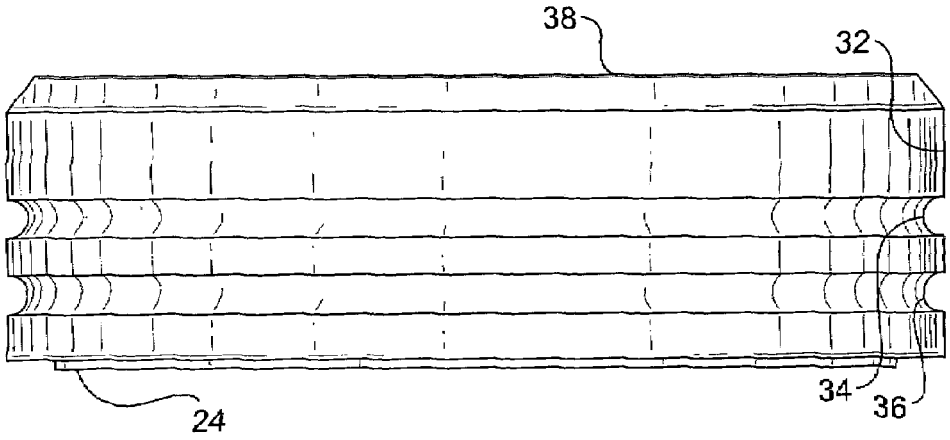
FIG. 4 is a left side elevation view of the reaction block of FIG. 1, the right side being a mirror image thereof.

FIGS. 1, 4 and 5 further illustrate the configuration of a solid PTFE shield that both substantially covers and surrounds all hot surfaces of the hot plate 70 as well as the inner flask holder 2, and also provides gripping surface regions completely around the circumference 32 of the reaction block. The shield has a thick annular portion with an upper surface 38 that extends inward to a cylindrical inner surface 60 that is closely spaced outwardly from the outside of cylindrical holder element 12. Hence, shield outer circumference 32 meets upper surface 38 at a chamfered corner and is backed by a thick annular ring of solid PTFE resin. That mass further acts to retard heat transfer away from the hot flask holder 2 or the hot plate 70 and towards the circumference 32. That surrounding, thick annular layer of insulating material is quite rigid and allows a very stable and continuous gripping surface region to be defined by round grooves 34, 36 which act as secure finger holding surfaces that are uniform and run completely around the circumference.

FIG. 5 further illustrates an intended use of the assembled reaction block upon a top surface of a conventional laboratory magnetic stirrer and hotplate, 62. The shape of a round hot plate upper surface 70 being about 135 mm in diameter is schematically represented by dotted line. The flat lower surface 80 of the thin wall, circular horizontal element 22 is about 138 mm in diameter and will engage over and around the flat area and edge of hot plate upper surface 70. The reaction block will be located against sliding by the holder vertical element 34, which in turn is covered by a PTFE shield. In this manner, the reaction block will remain fixed and centrally located within the magnetic field of the laboratory stirrer, but no hot surface will be exposed for an inadvertent contact with the hands of the lab technician.

Figure 6:
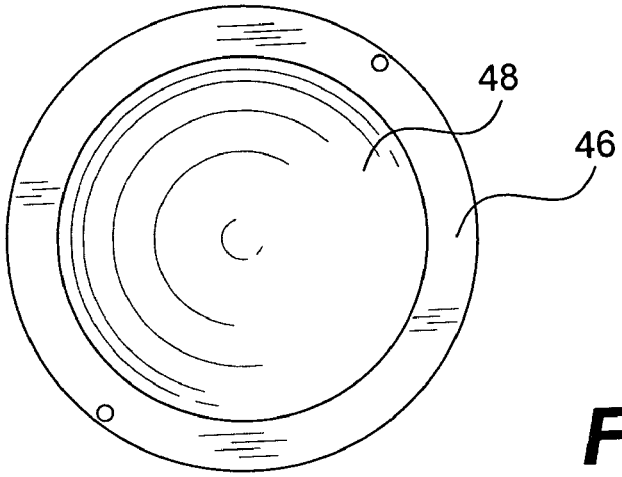
FIG. 6 is a top plan view of a first insert for accommodating a 50 ml round bottom flask.
Figure 9:
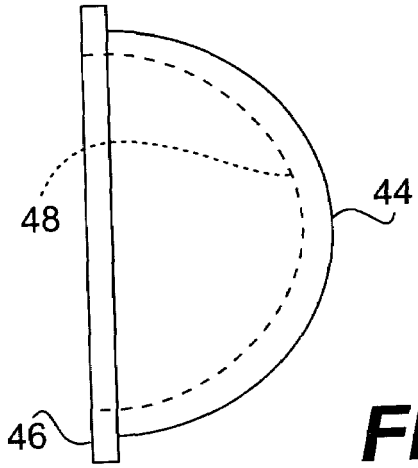
FIG. 9 is a side elevation view of a first insert for accommodating a 50 ml round bottom flask.

As shown in FIGS. 1, 6 and 9, the concave central recess 14, which is sized for engaging against a 100 ml flask bottom, also will engage against the rim 46 and lower convex surface 44 of an optional first adapter insert, that has an upper concave surface 48 sized to engage the bottom of a 50 mL flask. The upper surface 38 of the PTFE block has a notch 40 that registers radially with a notch 42 in the top support surface 50 of the inner flask holder 2. That facilitates engaging a tool under the insert rim 46 in order to lift out the insert.

Figure 7:
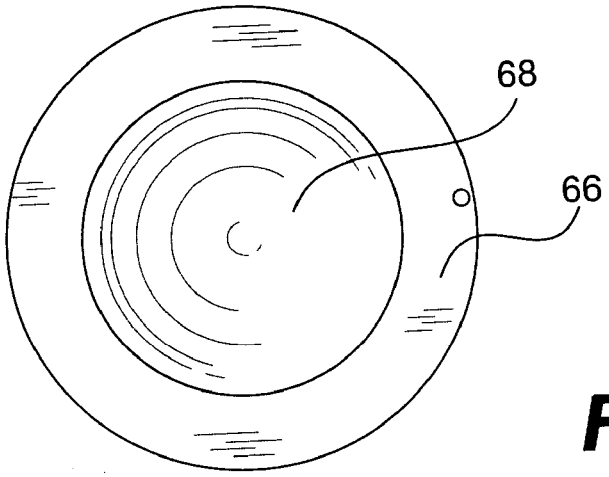
FIG. 7 is a top plan view of a second insert for accommodating a 25 ml round bottom flask.
Figure 8:
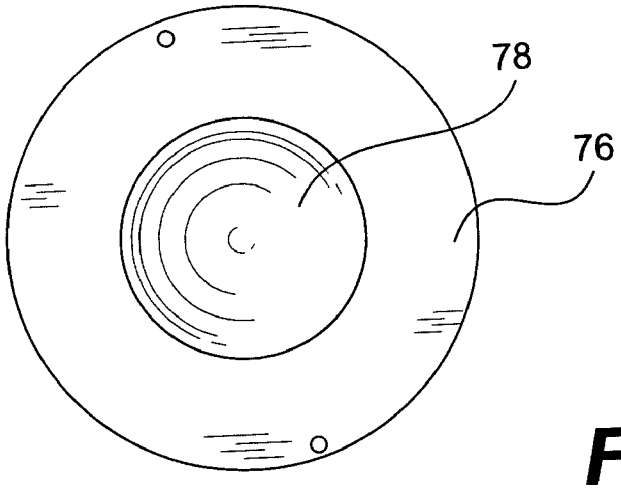
FIG. 8 is a top plan view of a third insert for accommodating a 10 ml round bottom flask.
Figure 10:
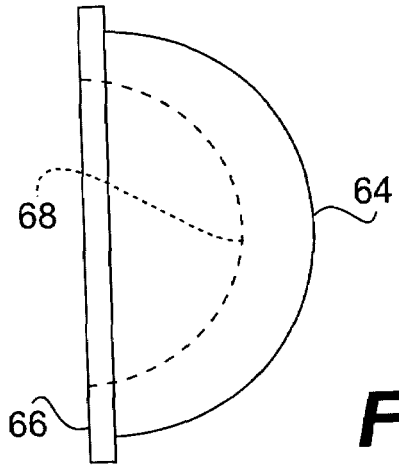
FIG. 10 is a side elevation view of a second insert for accommodating a 25 ml round bottom flask.
Figure 11:
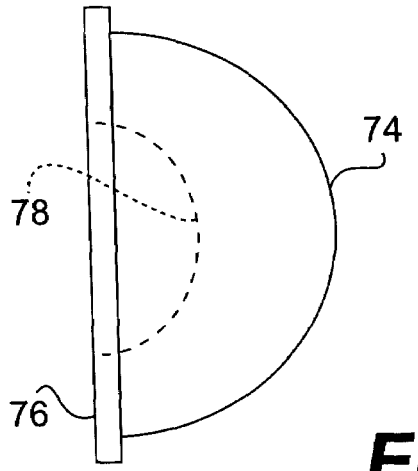
FIG. 11 is a side elevation view of a third insert for accommodating a 10 ml round bottom flask.

FIGS. 7 and 10 show a second adapter insert, having an upper concave surface 68 that will engage the bottom of a 50 mL flask, an annular rim 66 and a lower convex surface 64 that likewise will engage central recess 14. FIGS. 8 and 11 show a third adapter insert, having an upper concave surface 78 that will engage the bottom of a 10 mL flask, an annular rim 76 and a lower convex surface 74 that likewise will engage central recess 14.

The three inserts are machined from aluminum, and preferably are anodized in the different colors red, blue and yellow as a color code to facilitate proper selection in the lab.

Each of the inserts are shallow cups are of the same overall diameter and with the same sized annular rims, but have different wall thicknesses, in order to present a common lower convex surface configuration that will assist in making a large area contact against the concave surface 14 of the central recess in the inner flask holder. The upper concave surfaces of the insets are likewise shaped to make a large area contact with the bottom of a particular size of inserted flask, and are shallow to permit the lab technician to visually inspect a reaction occurring within the liquid being synthesized without the need to employ a surrounding oil bath or a heating mantle.

While preferred embodiments have been shown and described in order to satisfy the requirements of 35 USC § 112, the invention is to be defined solely by the scope of the appended claims

I claim:

1. A reaction block for mounting a flask upon a laboratory hot plate stirrer, essentially comprising an inner flask holder, of a heat conducting material that comprises a non-ferrous metal and does not interfere with a magnetic flux, with a holder above a horizontal element that has a lower surface adapted to engage upon a hot plate surface and a heat shield that comprises a heat insulating material that substantially surrounds exterior side and upper surfaces of the inner flask holder and is separated from those exterior side and upper surfaces by an air space, in order to define an exterior surface area of the reaction block that can be maintained at a temperature that is safe to touch when mounted on said hot plate.

2. A reaction block according to claim 1, wherein the non-ferrous metal is aluminum and the air space which substantially separates exterior side and upper surfaces of the inner flask holder from the surrounding heat insulating material is defined by spacers of a heat insulating material that are positioned at a plurality of locations on an upper surface of the horizontal element of the inner flask holder.

3. A reaction block according to claim 2, wherein fasteners connect the inner flask holder to the surrounding heat insulating material, and a fastener extends through a spacer in at least one location and engages the horizontal element.

4. A reaction block according to claim 1, wherein the heat insulating material comprises a single insulating block of a plastic or resin that is substantially circular and substantially surrounds exterior side and upper surfaces of a horizontal element that is circular, and the insulating block further comprises a vertical outer surface with gripping surface regions completely around its circumference.

5. A reaction block according to claim 4, wherein the single insulating block further comprises a rigid PTFE resin and air spaces separate outer surfaces of the inner flask holder from inner surfaces of the single insulating block of rigid PTFE resin.

6. A reaction block according to claim 5, wherein the gripping surface regions on the single insulating block of rigid PTFE resin are defined by a least one continuous groove, completely around its circumference.

7. A reaction block according to claim 5, wherein the air spaces are defined by spacers of a heat insulating material that are positioned between the insulating block and inner flask holder at a plurality of locations on an upper surface of the horizontal element of the inner flask holder.

8. A reaction block according to claim 7, wherein fasteners connect the inner flask holder to the surrounding single insulating block of rigid PTFE resin, and at least one fastener extends through a spacer in at least one location and engages the horizontal element.

9. A reaction block according to claim 1, wherein the inner flask holder further comprises a concave, central recess that is adapted to accept each of a series of inserts sized with upper concave surfaces that will accommodate different round bottom flasks wherein each insert has a common convex lower surface that will make good heat transfer contact with the concave, central recess.

10. A reaction block according to claim 9, wherein the inner flask holder further comprises a concave recess located in the top of a cylindrical aluminum element positioned above a circular thin wall aluminum horizontal element, and the insulating material further comprises an insulating block having inner surfaces spaced around the cylindrical aluminum element and above the horizontal element.

11. A reaction block according to claim 10, wherein interconnected air spaces are defined between outer surfaces of the inner flask holder and inner surfaces of the insulating block and the insulating block comprises an outer surface with an annular portion that further comprises gripping surface regions around its outer circumference.

12. A reaction block according to claim 11, wherein the insulating block further comprises a rigid PTFE resin, the interconnected air spaces are further defined by a plurality of spacers, between the insulated block and the inner flask holder, and the gripping surface regions further comprise at least one continuous groove, completely around its outer circumference.

13. A reaction block according to claim 9, wherein each of the series of aluminum adapters are substantially round and color coded as to the different size flask which is accommodated by its upper concave surface.

14. A reaction block according to claim 9, wherein the heat insulating material comprises a single insulating block of a plastic or resin that is substantially circular and substantially surrounds exterior side and upper surfaces of a circular inner flask holder, and the insulating block further comprises a vertical outer surface with gripping surface regions around its outer circumference.

15. A reaction block according to claim 14, wherein the single insulating block is a solid PTFE resin, the gripping surface regions further comprise at least one continuous groove, completely around its outer circumference, and the inner flask holder lower surface is circular and includes a extending edge that is adapted to engage vertically around common sizes of round hot plate stirrers.

16. A round reaction block essentially comprising a inner flask holder of heat conducting material that is surrounded by a layer of solid insulating material, wherein the inner flask further comprises a vertically extending element that is cylindrical and comprises aluminum supporting a flask holding recess above a horizontal element that comprises thin wall aluminum and is circular with a lower surface and vertical edge that will engage upon and around a common round hot plate stirrer, and the solid insulating layer is spaced from upper and side surfaces of the inner flask holder so as to define interconnected air spaces.

17. A reaction block according to claim 16, wherein the solid insulating material comprises a PTFE resin.

* * * * *